US009258659B2

(12) United States Patent
Pan et al.

(10) Patent No.: US 9,258,659 B2
(45) **Date of Patent: *Feb. 9, 2016**

(54) METHOD OF DETECTING ENCLOSURE LEAKAGE OF ENCLOSURE MOUNTED LOUDSPEAKERS

(71) Applicant: ANALOG DEVICES GLOBAL, Hamilton (BM)

(72) Inventors: Yang Pan, Shanghai (CN); Fanjiong Zhang, Shanghai (CN); Kim Spetzler Berthelsen, Køge (DK); Michael W. Determan, Brighton, MA (US)

(73) Assignee: ANALOG DEVICES GLOBAL, Hamilton (BM)

( * ) Notice: Subject to any disclaimer, the term of this patent is extended or adjusted under 35 U.S.C. 154(b) by 0 days.

This patent is subject to a terminal disclaimer.

(21) Appl. No.: 13/948,663

(22) Filed: Jul. 23, 2013

(65) Prior Publication Data

US 2015/0030167 A1 Jan. 29, 2015

(51) Int. Cl.
*H04R 29/00* (2006.01)
*H04R 3/00* (2006.01)
*H04R 3/08* (2006.01)

(52) U.S. Cl.
CPC ..... *H04R 29/001* (2013.01); *H04R 3/007* (2013.01); *H04R 3/08* (2013.01)

(58) Field of Classification Search
CPC .. H04R 1/2834; H04R 1/403; H04R 2499/11; H04R 9/022; H04R 1/02; H04R 1/021; H04R 1/1075; H04R 1/28; H04R 1/2811; H04R 1/2826; H04R 1/2857; H04R 1/2869; H04R 1/2873; H04R 1/2896; H04R 2400/00
USPC ..... 381/333, 334, 308, 388, 345, 396, 400, 381/412, 59, 55, 98; 181/151, 250, 269, 181/286; 29/601, 600; 455/575.3, 73, 41.2, 455/77

See application file for complete search history.

(56) References Cited

U.S. PATENT DOCUMENTS 6,269,318 B1 * 7/2001 Geddes ..... H04R 3/08 324/615
2004/0017921 A1 1/2004 Mantovani
2005/0238178 A1 10/2005 Garcia et al.

(Continued)

FOREIGN PATENT DOCUMENTS

EP 2538699 A1 12/2012
WO 2004080116 A2 9/2004
WO 2011079875 A1 7/2011

OTHER PUBLICATIONS

Andrew Bright, "Adaptive IIR Filters for Loudspeaker Parameter Tracking", AES 32nd International Conference, Hillerod, Denmark, Sep. 21-23, 2007, 8 pages.

(Continued)

*Primary Examiner* — Sunita Joshi
(74) *Attorney, Agent, or Firm* — Kenyon & Kenyon LLP

(57) ABSTRACT

A method of detecting enclosure leakage of an electrodynamic loudspeaker mounted in an enclosure or box may include applying an audio signal to a voice coil of the electrodynamic loudspeaker through an output amplifier and detecting a voice coil current flowing into the voice coil. A voltage across the voice coil may be detected and an impedance or admittance of the loudspeaker across a predetermined audio frequency range may be detected based on the detected voice coil current and voice coil voltage. A fundamental resonance frequency of the loudspeaker may be determined based on the detected impedance or admittance and compared with a nominal fundamental resonance frequency of the loudspeaker representing a sealed state of the enclosure. Acoustic leakage of the enclosure may be detected based on a deviation between the determined the fundamental resonance frequency and the nominal fundamental resonance frequency of the electrodynamic loudspeaker.

23 Claims, 6 Drawing Sheets

(56) References Cited

U.S. PATENT DOCUMENTS

| | | | | |
|---|---|---|---|---|
| 2012/0288118 | A1* | 11/2012 | Gautama | H04R 3/007 381/98 |
| 2012/0294450 | A1* | 11/2012 | Ozcan | H04R 3/007 381/59 |
| 2013/0077795 | A1* | 3/2013 | Risbo et al. | 381/55 |

OTHER PUBLICATIONS

Extended European Search Report issued Dec. 16, 2014, in counterpart European application No. 14176548.7, 12 pages.

Extended European Search Report issued Dec. 16, 2014, in European application No. 14176554.5, 13 pages.

* cited by examiner

A)

B)

METHOD OF DETECTING ENCLOSURE LEAKAGE OF ENCLOSURE MOUNTED LOUDSPEAKERS

The present invention relates in one aspect to a method of detecting enclosure leakage of an electrodynamic loudspeaker mounted in an enclosure or box. The methodology comprises steps of applying an audio signal to a voice coil of the electrodynamic loudspeaker through an output amplifier and detecting a voice coil current flowing into the voice coil. A voice coil voltage across the voice coil is also detected and an impedance or admittance of the loudspeaker across a predetermined audio frequency range is detected based on the detected voice coil current and voice coil voltage. A fundamental resonance frequency of the loudspeaker is determined based on the detected impedance or admittance and compared with a nominal fundamental resonance frequency of the loudspeaker representing a sealed state of the enclosure. Acoustic leakage of the enclosure is detected based on a deviation between the determined the fundamental resonance frequency and the nominal fundamental resonance frequency of the electrodynamic loudspeaker. Another aspect to the invention relates to a corresponding leakage detection assembly for detecting enclosure leakage of an electrodynamic loudspeaker mounted in an enclosure.

BACKGROUND OF THE INVENTION

The present invention relates to a method of detecting enclosure leakage of an electrodynamic loudspeaker mounted in a box and a corresponding assembly for detecting enclosure leakage of an enclosure or box of an electrodynamic loudspeaker. Detection of acoustic leakage of an intentionally sealed enclosure of an electrodynamic loudspeaker is highly useful in numerous sound reproduction applications and equipment. It is important to rapidly and reliably detect enclosure leakage because of the associated loss of mechanical stiffness or compliance of the trapped air mass inside the sealed enclosure behind the loudspeaker diaphragm. The loss of stiffness leads to markedly increased diaphragm excursion for a given voice coil voltage, i.e. for a given level of the audio signal. The increase of diaphragm excursion is likely to force the diaphragm and voice coil assembly of the loudspeaker beyond its maximum allowable peak excursion leading to various kinds of irreversible mechanical damage to the loudspeaker. The user will typically notice this kind of irreversible mechanical damage of the loudspeaker due to a grossly distorted sound quality of the loudspeaker or a complete absence of audible sound.

This problem is of significant importance in numerous areas of loudspeaker technology, but in particular in miniature loudspeakers for portable communication devices such as mobile phones and smartphones. In the latter type of devices, a miniature electrodynamic loudspeaker is often mounted in a small sealed enclosure or chamber for example having a volume of about 1 $cm^3$. The way users handle mobile phones and smartphones makes it unavoidable that these occasionally are dropped. These accidental drops may, depending on the impact surface and drop height, lead to severe impact blows on the phone housing or casing. Experience shows that these impacts often are sufficiently large to break a small hole of crack in the small sealed enclosure of the miniature loudspeaker leading to the undesired acoustic leakage. While the costs of a replacement miniature electrodynamic loudspeaker itself are quite modest, the costs of handling the entire repair service procedure are high. This is caused by the multitude of operational activities which typically includes various transportation and order tracking activities, disassembling of the communication device, removal of the defective miniature speaker, mounting of a new miniature speaker, testing, re-assembling and returning etc. In addition, the user is left without an often vital communication tool for the duration of the repair procedure. Hence, it is of considerable value to rapidly and reliably detect enclosure leakage and apply proper precautionary measures in the portable communication device to prevent damage to the miniature electrodynamic loudspeaker by limiting the diaphragm excursion to a value below its maximum allowable peak excursion.

Furthermore, it is of significant interest and value to provide a relatively simple method for monitoring and detecting enclosure leakage to avoid excessive expenditure of computational resources of a microprocessor of the portable communication device and/or other hardware resources handling a leakage detection application.

SUMMARY OF THE INVENTION

A first aspect of the invention relates to a method of detecting enclosure leakage of an electrodynamic loudspeaker mounted in an enclosure, comprising steps of:

applying an audio signal to a voice coil of the electrodynamic loudspeaker through an output amplifier, detecting a voice coil current flowing into the voice coil, detecting a voice coil voltage across the voice coil, detecting an impedance or admittance of the loudspeaker across a predetermined audio frequency range based on the detected voice coil current and voice coil voltage, determining a fundamental resonance frequency of the loudspeaker based on the detected impedance or admittance, comparing the determined the fundamental resonance frequency of the loudspeaker with a nominal fundamental resonance frequency of the loudspeaker representing a sealed state of the enclosure, detecting the acoustic leakage of the enclosure based on a deviation between the determined the fundamental resonance frequency and the nominal fundamental resonance frequency of the electrodynamic loudspeaker.

The skilled person will appreciate that each of the audio signal, the voice coil voltage, and the voice coil current may be represented by an analog signal for example as a voltage, current, charge etc. or alternatively be represented by a digital signal, e.g. sampled and coded in binary format at a suitable sampling rate and resolution.

The present method of detecting enclosure leakage of the enclosure of the electrodynamic loudspeaker exploits a leakage induced shift or change of fundamental resonance frequency of the enclosure mounted loudspeaker to monitor and detect enclosure leakage. This change of fundamental resonance frequency of the electrodynamic loudspeaker is preferably detected in real-time during normal operation of the loudspeaker to allow appropriate excursion limiting measures to be applied substantially instantaneously in response to acoustic leakage of the loudspeaker enclosure. Hence, the risk of forcing the movable diaphragm assembly to excessive excursion is minimized and so is the accompanying risk of mechanical damage of the loudspeaker.

The audio signal applied to the loudspeaker during normal operation may comprise speech and/or music supplied from a suitable audio source such as radio, CD player, network player, MP3 player. The audio source may also comprise a microphone generating a real-time microphone signal in response to incoming sound.

The present enclosure leakage detection methodology may be applied to a wide range of sealed enclosure mounted electrodynamic loudspeakers such as large diameter woofers or broad-band loudspeakers for High Fidelity, automotive or Public Address applications as well as to miniature electrodynamic loudspeakers for portable communication devices and/or music players. In the latter case, the electrodynamic loudspeaker may be integrated in a mobile phones or smartphone and mounted in a sealed enclosure with a volume between 0.5 and 2.0 $cm^3$ such as about 1 $cm^3$. The enclosure mounted electrodynamic loudspeaker may produce useful sound pressure from below 100 Hz and up to 15 kHz, or even up to 20 kHz. In the present context, the fundamental resonance frequency of the electrodynamic loudspeaker is the resonance frequency determined or set by total compliance acting on the movable diaphragm assembly and the total moving mass of the electrodynamic loudspeaker. The total compliance acting on the movable diaphragm assembly will typically comprise a parallel connection of a compliance of an edge suspension of the loudspeaker and a compliance caused by the trapped air inside the sealed enclosure. The fundamental resonance frequency of the enclosure mounted electrodynamic loudspeaker can be identified by inspection of its low-frequency peak electrical impedance. If the enclosure becomes leaky, the fundamental resonance frequency of the electrodynamic loudspeaker decreases in direction of a free-air fundamental resonance frequency of the electrodynamic loudspeaker because of increasing compliance (or decreasing stiffness) of the trapped air in the enclosure as illustrated below in connection with the appended drawings.

The nominal fundamental resonance frequency represents an expected or measured fundamental resonance frequency of the electrodynamic loudspeaker mounted in the relevant enclosure when the latter is appropriately sealed, i.e. its sealed state or non-leaking state. The nominal fundamental resonance frequency can accordingly be set in various ways. According to one embodiment of the invention, the nominal fundamental resonance frequency is based on the speaker manufacturer's data sheet for the actual combination of sealed enclosure volume and the electrodynamic loudspeaker model in question. In this case, the nominal fundamental resonance frequency may represent an average, or any other suitable statistical measure, resonance frequency value for the particular type of electrodynamic loudspeaker in question. This embodiment may be used to test or verify correct sealed mounting of the loudspeaker in the enclosure or chamber during manufacturing. This test or verification may be accomplished by measuring the fundamental resonance frequency of the loudspeaker after enclosure mounting and compare the measured fundamental resonance frequency with the nominal fundamental resonance frequency. If the measured value of the fundamental resonance frequency falls below a preset frequency threshold frequency or outside certain a predetermined frequency band or range around the nominal fundamental resonance frequency, the enclosure may be flagged as leaking. This flag may be used to inspect and possibly repair the enclosure and/or the mounting of the loudspeaker therein during the manufacturing process and hence avoid expensive and annoying field returns of for example a portable communication device housing the enclosure mounted loudspeaker.

The above outlined expectation based determination of the nominal fundamental resonance frequency of the loudspeaker may be less accurate than desired in certain situations due to sample-to-sample manufacturing spread on the fundamental resonance frequency of the type electrodynamic loudspeaker in question. Hence, in other embodiments, the nominal fundamental resonance frequency may be represented by a measured fundamental resonance frequency of the electrodynamic loudspeaker in question as determined from an operational measurement on the electrodynamic loudspeaker when mounted in the enclosure in the sealed state. Under this operational measurement, the enclosure is accordingly in a known appropriately sealed condition. The measurement of the fundamental resonance frequency may be accomplished during manufacturing of a device in which the electrodynamic loudspeaker and associated enclosure is integrated. In both of these embodiments, the set value of the nominal fundamental resonance frequency may be stored in digital format in an electronic memory of the portable device such as a non-volatile memory area.

The output amplifier preferably comprises a switching or class D amplifier for example a Pulse Density Modulation (PDM) or Pulse Width Modulation (PWM) output amplifier which both possess high power conversion efficiency. This is a particularly advantageous feature for use in battery powered portable communication devices. In the alternative, the output amplifier may comprise traditional non-switched power amplifier topologies like class A or class AB.

The present methodology of detecting enclosure leakage is preferably configured to additionally limit or control the diaphragm displacement or excursion of the electrodynamic loudspeaker to prevent various kinds of mechanical damage to the loudspeaker as discussed above. The mechanical damage may be caused by collision between movable loudspeaker components, such as the voice coil, diaphragm or voice coil bobbin, and a stationary component such as the magnetic circuit. The attenuation of the audio signal level may be accomplished by attenuating a level of the audio signal or a level of the voice coil voltage or current. The level attenuation may comprises selectively attenuating a low-frequency portion of the audio signal such as a low-frequency portion below the nominal fundamental resonance frequency of the electrodynamic loudspeaker as these frequencies are more likely to drive the loudspeaker above its maximum excursion limit. Alternatively, the level attenuation may be carried out by broad band attenuation of the entire spectrum of the audio signal.

Several methodologies may be applied to decide when excursion limiting measures are to be applied to the loudspeaker based on the determined the fundamental resonance frequency. According to one embodiment, the method of detecting enclosure leakage of an electrodynamic loudspeaker comprises steps of:

monitoring and measuring the fundamental resonance frequency of the loudspeaker over time, comparing the measured fundamental resonance frequency with a predetermined frequency error criterion, limiting diaphragm excursion of the loudspeaker based on an outcome of the comparison.

The predetermined frequency error criterion may comprise a maximum frequency deviation between the determined fundamental resonance frequency and the nominal fundamental resonance frequency of the loudspeaker. The maximum frequency deviation may have a preset value of e.g. 200 Hz or larger for typical sealed enclosure mounted miniature loudspeakers of portable communication terminals. Hence, the limitation of the diaphragm excursion of the loudspeaker may be invoked if the measured or detected fundamental resonance frequency drops more than the preset value, e.g. 200 Hz, 300 Hz or 400 Hz, below the nominal fundamental resonance frequency. Another embodiment of the predetermined frequency error criterion is based on a simple threshold criterion where the setting of the threshold frequency may be derived from the known nominal fundamental resonance frequency of the loudspeaker. The threshold frequency is set to an absolute value, such as 500 Hz, 600 Hz etc. which preferably lies below a normal range of variation or spread of the nominal fundamental resonance frequency. Hence, if the determined fundamental resonance frequency falls below the threshold frequency, it can safely be assumed that enclosure leakage has occurred and the excursion limiting measures are to be invoked.

Another advantageous embodiment of the present methodology of detecting enclosure leakage includes increased robustness against temporary abnormal orientation conditions of the portable communication device in which the loudspeaker is integrated for sound reproduction purposes. This embodiment comprises steps of detecting a failure time during which the determined fundamental resonance frequency meets or matches the predetermined frequency error criterion, comparing the detected failure time with a predetermined failure time period, limiting diaphragm excursion in response to the detected failure time exceeds the predetermined failure time period. According to the latter embodiment, the methodology may ignore a temporary compliance with or match to the predetermined frequency error criterion, such as a larger than acceptable deviation between the determined and nominal fundamental resonance frequencies, if the compliance is of shorter duration than the predetermined failure time period. Alternatively, the diaphragm excursion limitation may be immediately activated in response to compliance and subsequently cancelled once the fundamental resonance frequency again fails to comply with the predetermined frequency error criterion. This embodiment is particularly helpful in allowing the leakage detection methodology to ignore certain acceptable and temporary handling events of the device in which the loudspeaker is integrated. These temporary handling events introduce a temporary change of acoustic loading on the frontal side of the loudspeaker such that the measured fundamental resonance frequency of the loudspeaker is temporarily altered. This kind of temporary change of the frontal side acoustic loading may be caused by placing a sound aperture or opening of the device against a blocking surface such as table. The temporary blocking of the sound aperture will typically result in a temporary increase or decrease of the measured fundamental resonance frequency of the loudspeaker even though the speaker enclosure in fact is perfectly intact, i.e. without acoustic leakage. Hence, these kind of temporary acceptable handling events may be prevented from activating the diaphragm excursion limitation measures or the diaphragm excursion limitation measures may at least be eliminated at the end of temporary handling event. To detect this type of temporary acoustic blocking of the frontal side of the loudspeaker, the predetermined frequency error criterion may comprise both a lower frequency threshold and upper frequency threshold or a frequency range or span around the nominal fundamental resonance frequency. If the measured fundamental resonance frequency falls below the lower frequency threshold, the methodology may assume that an acoustic leaking condition of the enclosure has been encountered and activate appropriate diaphragm excursion limitation actions. On the other hand, if the measured fundamental resonance frequency increases to a frequency above the upper frequency threshold, the methodology may assume that a temporary acoustic blocked condition of the loudspeaker has been encountered and choose to either ignore this event or perform other actions as described below in further detail in connection with the appended drawings.

Another advantageous embodiment of the present methodology of detecting enclosure leakage includes increased discrimination between the above-discussed temporary abnormal acoustic loading conditions of the loudspeaker and enclosure leakage by additionally monitoring the impedance or admittance of the loudspeaker at the fundamental resonance frequency. Under certain acoustic loading conditions or circumstances, the change of measured fundamental resonance frequency may be rather small and appear to be caused by acoustic leakage unless a further error criterion is evaluated or examined as described below in further detail in connection with the appended drawings. The addition of the further error criterion may advantageously comprise steps of comparing the measured impedance or admittance of the loudspeaker at the fundamental resonance frequency to a predetermined impedance error criterion and limiting diaphragm excursion of the loudspeaker based on an outcome of the comparison. The predetermined impedance error criterion may comprise upper and lower impedance limits at a certain frequency such as the measured fundamental resonance frequency or an impedance range around the measured fundamental resonance frequency.

The skilled person will appreciate that the detection of the impedance or admittance of the loudspeaker across a predetermined audio frequency range may be carried by a number of different schemes. According to one embodiment, corresponding values of the voice coil current and voice coil voltage are measured one or more frequency bands in the predetermined audio frequency range such that a ratio between these quantities directly reflects the impedance or admittance per band. According to one such embodiment, the method comprises steps of:

filtering the voice coil current by a plurality of adjacently arranged bandpass filters across the predetermined audio frequency range to produce a plurality of bandpass filtered voice coil current components, filtering the voice coil voltage by a plurality of adjacently arranged bandpass filters across the predetermined audio frequency range to produce a plurality of bandpass filtered voice coil voltage components, determining one of the voice coil impedance and admittance within a pass band of each bandpass filter based on the voice coil current component and voice coil voltage component. The plurality of adjacently arranged bandpass filters may comprise a time-domain filter bank and/or a frequency domain filter bank. The frequency domain filter bank may for example comprise a Fourier Transform based filter bank such as an FFT filter bank with a suitable frequency resolution at and below the nominal fundamental resonance frequency such as a bin spacing somewhere between 25 Hz and 100 Hz. In a number of alternative embodiments the time-domain filter bank comprises traditional octave spaced filters for example a plurality of ⅙ or ⅓ octave spaced bandpass filters. The plurality of bandpass filters are preferably implemented as digital filters for example IIR digital filters.

Another advantageous embodiment of the invention utilizes a model based methodology or approach to compute the fundamental resonance frequency of the loudspeaker. This methodology comprises steps of applying the detected voice coil current and the detected voice coil voltage to an adaptive digital model of the loudspeaker, said adaptive digital model comprising a plurality of adaptable model parameters, computing the fundamental resonance frequency of the loudspeaker based one or more of the adaptable parameters of the adaptive digital model of the loudspeaker.

The adaptive digital model of the loudspeaker preferably comprises an adaptive digital filter, for example an adaptive IIR filter of second or higher order, which models a time varying and frequency dependent impedance of the loudspeaker across a predetermined audio frequency range, for example between 10 Hz and 10 kHz. The detected voice coil current and detected voice coil voltage are preferably represented by a digital voice coil current signal and a digital voice coil voltage, respectively, as explained in additional detail below with reference to the appended drawings.

To assist proper adaptation of the adaptive digital model of the loudspeaker the latter preferably comprises at least one fixed parameter such as a total moving mass of the loudspeaker in addition to the one or more adaptable or free model parameters.

A second aspect of the invention relates to a leakage detection assembly for an enclosure mounted electrodynamic loudspeaker. The leakage detection assembly comprises an audio signal input for receipt of an audio input signal supplied by an audio signal source, an output amplifier configured to receive the audio signal and generate a corresponding voice coil voltage at a pair of output terminals connectable to a voice coil of an electrodynamic loudspeaker and a current detector configured for detecting a voice coil current flowing into the electrodynamic loudspeaker in response to the application of the voice coil voltage. The leakage detection assembly; further comprises a signal processor configured to:

detecting an impedance or an admittance of the loudspeaker across a predetermined audio frequency range based on the detected voice coil current and voice coil voltage, determining a fundamental resonance frequency of the loudspeaker based on the detected impedance or admittance, comparing the determined the fundamental resonance frequency of the loudspeaker with a nominal fundamental resonance frequency of the loudspeaker representing a sealed state of the enclosure, detecting enclosure leakage based on a deviation between the determined the fundamental resonance frequency and the nominal fundamental resonance frequency of the electrodynamic loudspeaker.

The properties of the output amplifier have been disclosed in detail above in connection with the corresponding excursion detection methodology. The Class D output amplifier may comprises a half-bridge driver stage with a single output coupled to the electrodynamic loudspeaker or a full-bridge/H-bridge driver stage with the pair of output terminals coupled to respective sides or terminals of the electrodynamic loudspeaker.

The audio input signal may comprise a real-time digital audio signal supplied from an external digital audio source such as a digital microphone. The real-time digital audio signal may be formatted according to a standardized serial data communication protocol such as IIC or SPI, or formatted according to a digital audio protocol such as $I^2S$, SPDIF etc.

The nominal fundamental resonance frequency may be stored in digital format in a suitable data memory location of a data memory device of the leakage detector assembly implementing the present leakage detection methodology. The data memory device may be integrated on the signal processor. The skilled person will appreciate that the signal processor preferably comprises a software programmable processor such as a microprocessor or DSP integrated on, or operatively coupled to, the leakage detector assembly. The software programmable microprocessor or DSP is controlled by an application program of executable program instructions stored in a program memory such that the above steps or operations of the signal processor are executed when the application program is executed as described below in additional detail.

The skilled person will appreciate that the current detector may comprise various types of current sensors for example a current mirror connected to an output transistor of the output amplifier or a small sense resistor coupled in series with the loudspeaker voice coil. The voice coil current may accordingly be represented by a proportional/scaled sense voltage. The latter sense voltage may be sampled by an A/D converter to allow processing of the voice coil current in the digital domain. Preferably, both the voice coil current and voice coil voltage are processed in the digital domain such that a preferred embodiment of the leakage detection assembly comprises a first A/D converter configured to sample and digitize the voice coil current to supply a digital voice coil current signal; and a second A/D converter configured to sample and digitize the voice coil voltage to supply a digital voice coil voltage signal.

One embodiment of the leakage detection assembly utilizes the previously described model based methodology or approach to compute the fundamental resonance frequency of the loudspeaker. According to this embodiment, the application program comprises a first set of executable instructions providing, when executed, an adaptive digital model of the loudspeaker comprising a plurality of adaptable model parameters. A second set of executable instructions provides, when executed, steps of: reading the digital voice coil current signal, reading a digital voice coil voltage signal, applying the digital voice coil current signal and the digital voice coil voltage signal to the adaptive digital model of the loudspeaker, computing updated values of the plurality of adaptable model parameters, computing the fundamental resonance frequency of the loudspeaker from one or more of the adaptable model parameters. The features and advantages of the adaptive digital model of the loudspeaker have previously been discussed in detail above.

An alternative embodiment of the leakage detection assembly utilizes the previously described ratio between the measured voice coil current and voice coil voltage to compute the fundamental resonance frequency during operation According to the latter embodiment, the application program comprises:

a first set of executable instructions configured to, when executed, providing steps of:

filtering the digital voice coil voltage signal by a plurality of adjacently arranged bandpass filters across the predetermined audio frequency range to produce a plurality of bandpass filtered voice coil voltage components, filtering the digital voice coil current signal by a plurality of adjacently arranged bandpass filters across the predetermined audio frequency range to produce a plurality of bandpass filtered voice coil current components, determining one of the voice coil impedance and admittance within a pass band of each bandpass filter based on the voice coil current component and voice coil voltage component.

A third aspect of the invention relates to a semiconductor substrate or die on which a leakage detection assembly according to any of the above-described embodiments is integrated. The semiconductor substrate may be fabricated in a suitable CMOS or DMOS semiconductor process.

A fourth aspect of the invention relates to a leakage detection system for an enclosure mounted electrodynamic loudspeakers, comprising:

an electrodynamic loudspeaker comprising a movable diaphragm assembly for generating audible sound in response to actuation of the diaphragm assembly, a leakage detection assembly according to any of the above-discussed embodiments thereof electrically coupled to the movable diaphragm assembly. An audio signal source is operatively coupled to the audio signal input of the leakage detection assembly.

The present leakage detection system may advantageously function as a self-contained audio delivery system with integral loudspeaker excursion detection and excursion control that can operate independently of an application processor of the portable communication terminal to provide reliable and convenient protection against excursion induced mechanical damage of the electrodynamic loudspeaker.

BRIEF DESCRIPTION OF THE DRAWINGS

Preferred embodiments of the invention will be described in more detail in connection with the appended drawings, in which.

DETAILED DESCRIPTION OF PREFERRED EMBODIMENTS

Figure 1:
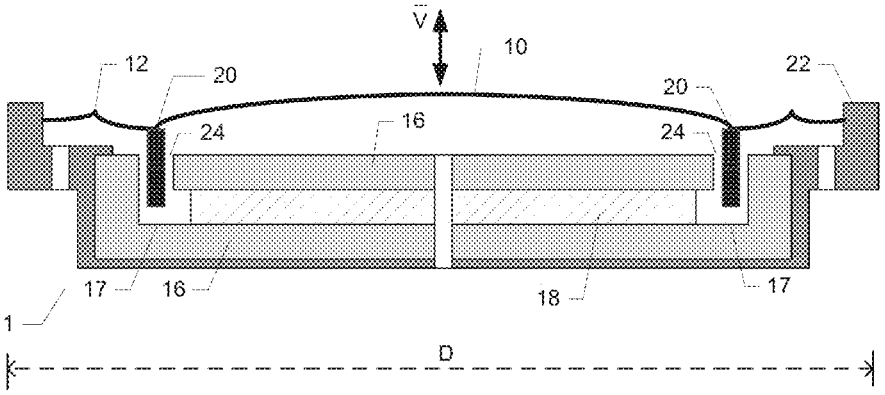
FIG. 1A) is a schematic cross-sectional view of a miniature electrodynamic loudspeaker for various portable sound reproducing applications for use in the present invention, FIG. 1B) is a schematic cross-sectional view of the miniature electrodynamic loudspeaker mounted in an enclosure with acoustic leakage.
Figure 1:
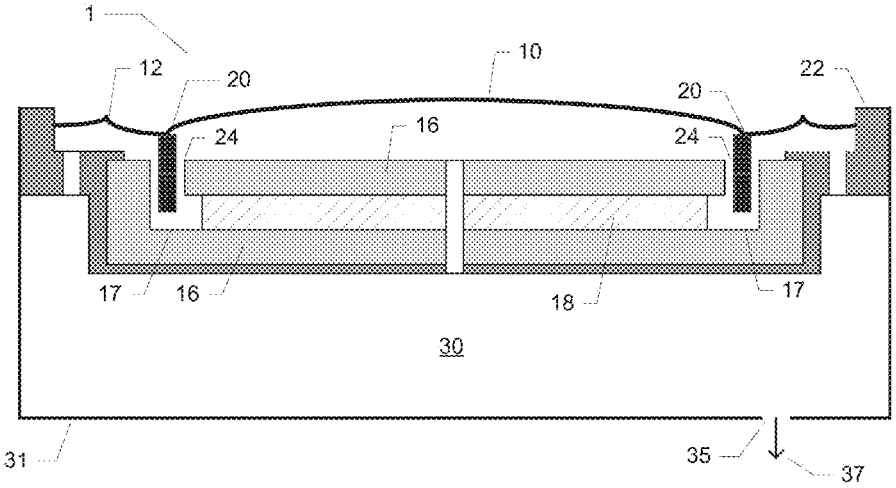

FIG. 1A) is a schematic cross-sectional illustration of a typical miniature electrodynamic loudspeaker 1 for sealed box mounting and use in portable audio applications such as mobile phones and smartphones where the loudspeaker 1 provides sound reproduction for various types of applications such as speaker phone and music playback. The skilled person will appreciate that electrodynamic loudspeakers exist in numerous shapes and sizes depending on the intended application. The electrodynamic loudspeaker 1 used in the below described methodologies of detecting enclosure leakage and the corresponding assemblies for detecting enclosure leakage has a rectangular shape with maximum outer dimension, D, of approximately 15 mm and an outer dimension in transversal direction of about 11 mm. However, the skilled person will appreciate that the present methodologies for leakage detection and corresponding detection assemblies for enclosure mounted electrodynamic loudspeakers are applicable to virtually all types of enclosure or box mounted electrodynamic loudspeakers.

The miniature electrodynamic loudspeaker 1 comprises a diaphragm 10 fastened to an upper edge surface of a voice coil. The diaphragm 10 is also mechanically coupled to a speaker frame 22 through a resilient edge or outer suspension 12. An annular permanent magnet structure 18 generates a magnetic flux which is conducted through a magnetically permeable structure 16 having a circular air gap 24 arranged therein. A circular ventilation duct 14 is arranged in the frame structure 22 and may be used to conduct heat away from an otherwise sealed chamber structure formed d beneath the diaphragm 10. The resilient edge suspension 12 provides a relatively well-defined compliance of the movable diaphragm assembly (voice coil 20 and diaphragm 10). The compliance of the resilient edge suspension 12 and a moving mass of the diaphragm 10 determines the free-air fundamental resonance frequency of the miniature loudspeaker. The resilient edge suspension 12 may be constructed to limit maximum excursion or maximum displacement of the movable diaphragm assembly.

During operation of the miniature loudspeaker 1, a voice coil voltage or drive voltage is applied to the voice coil 20 of the loudspeaker 100 thorough a pair of speaker terminals (not shown) electrically connected to a suitable output amplifier or power amplifier. A corresponding voice coil current flows in response through the voice coil 20 leading to essentially uniform vibratory motion, in a piston range of the loudspeaker, of the diaphragm assembly in the direction indicated by the velocity arrow V. Thereby, a corresponding sound pressure is generated by the loudspeaker 1. The vibratory motion of the voice coil 20 and diaphragm 10 in response to the flow of voice coil current is caused by the presence of a radially-oriented magnetic field in the air gap 24. The applied voice coil current and voltage lead to power dissipation in the voice coil 20 which heats the voice coil 20 during operation. Hence, prolonged application of too high drive voltage and current may lead to overheating of the voice coil 20 which is another common cause of failure in electrodynamic loudspeakers.

The application of excessively large voice coil currents which force the movable diaphragm assembly beyond its maximum allowable excursion limit is another common fault mechanism in electrodynamic loudspeakers leading to various kinds of irreversible mechanical damage. One type of mechanical damage may for example be caused by collision between the lowermost edge of the voice coil 20 and an annular facing portion 17 of the magnetically permeable structure 16.

FIG. 1B) is a schematic cross-sectional illustration of the miniature electrodynamic loudspeaker 1 mounted in an enclosure, box or chamber 31 having a predetermined interior volume 30. The enclosure or chamber 31 is arranged below the diaphragm 10 of the loudspeaker 1. An outer peripheral wall of the frame structure 22 of the loudspeaker 1 is firmly attached to a mating wall surface of the sealed box 31 to form a substantially air tight coupling acoustically isolating the trapped air inside volume 30 from the surrounding environment. The enclosed volume 30 may be between 0.5 and 2.0 $cm^3$ such as about 1 $cm^3$ for typical portable terminal applications like mobile phones and smartphones. The mounting of the loudspeaker 1 in the sealed enclosure 30 leads to a higher fundamental resonance frequency of the miniature loudspeaker than the its free-air fundamental resonance frequency discussed above due to a compliance of the trapped air inside the chamber 30. The compliance of the trapped air inside the chamber 30 works in parallel with the compliance of the resilient edge suspension 12 to decrease the total compliance (i.e. increase the stiffness) acting on the moving mass of the loudspeaker. Therefore, the fundamental resonance frequency of the enclosure mounted loudspeaker 1 is higher than the free air resonance. The amount of increase of fundamental resonance frequency depends on the volume of the enclosure 30. The wall structure surrounding the sealed enclosure 31 may be a formed by a molded elastomeric compound with limited impact strength. An undesired small hole or crack 35 in the wall structure 31 of the enclosure 30 has been schematically illustrated and the associated acoustic leakage of sound pressure to the surrounding environment indicated by the arrow 37. The acoustic leakage through the small hole or crack 35 leads to an undesired leaky state of the enclosure 30 and to a change of the fundamental resonance frequency of the loudspeaker 1 as discussed above. This change of the fundamental resonance frequency caused by the small hole or crack 35 is detected by monitoring an electrical impedance of the loudspeaker 1 as described in further detail below.

Figure 2:
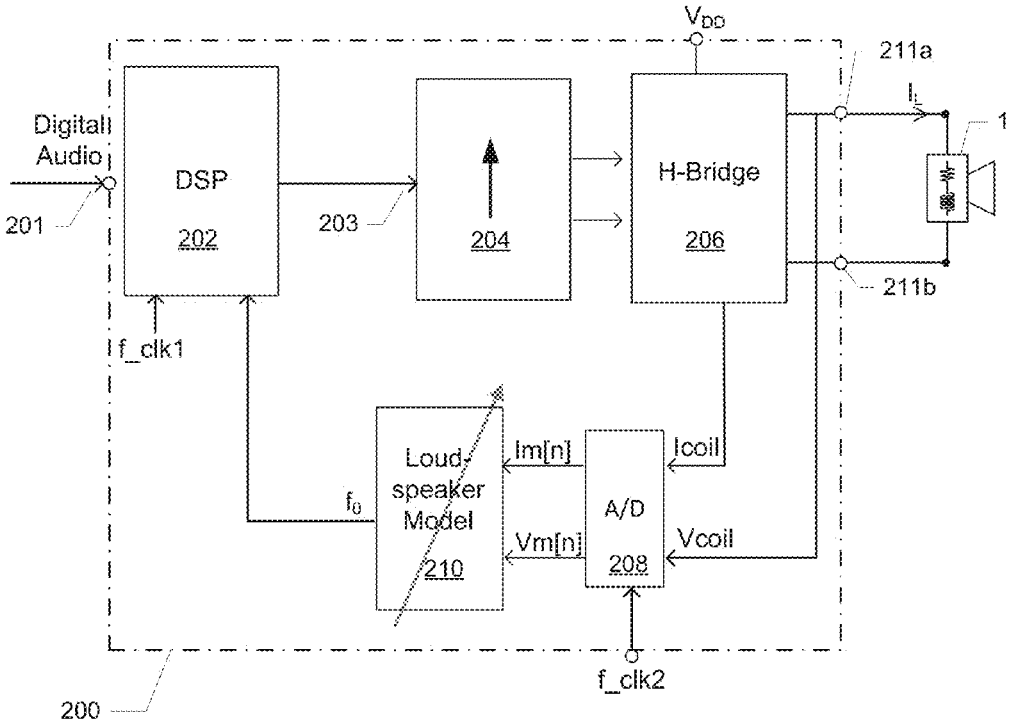
FIG. 2 shows a schematic block diagram of a leakage detection assembly for sealed enclosure mounted electrodynamic loudspeakers in accordance with a first embodiment of the invention.

FIG. 2 is a simplified schematic block diagram of a leakage detection assembly 200 for enclosure mounted electrodynamic loudspeakers for example the miniature loudspeaker 1 illustrated on FIG. 1B) above. The leakage detection assembly 200 is coupled to the miniature electrodynamic loudspeaker 1 through a pair of externally accessible speaker terminals 211*a*, 211*b*. A pulse modulated Class D output amplifier comprises a composite up-sampler and modulator 204 coupled to an H-bridge output stage 206 which in turn is connected to the speaker terminals 211*a*, 211*b*. The class D output amplifier receives a processed digital audio signal at input 203, derived from a digital audio signal supplied at digital audio signal input 201 of a programmable Digital Signal Processor (DSP) 202. The Class D output amplifier generates a corresponding PWM or PDM modulated voice coil voltage that is supplied to the voice coil of the miniature electrodynamic loudspeaker 1 through suitable speaker terminals. In the present embodiment, the leakage detection assembly 200 operates primarily in the digital domain, but other embodiments thereof may instead use analog signals or a mixture of analog and digital signals. The digital audio signal input 201 of the leakage detection assembly 200 receives the previously discussed digital audio signal supplied by an external digital audio source such as an application processor of a portable communication device in which the present leakage detection assembly 200 is integrated. The externally generated digital audio signal may be formatted according to a standardized serial data communication protocol such as IIC or SPI, or formatted according to a digital audio protocol such as IIS, SPDIF etc.

The leakage detection assembly 200 is supplied with operating power from a positive power supply voltage $V_{DD}$. Ground (not shown) or a negative DC voltage may form a negative supply voltage for the loudspeaker excursion detector 200. The DC voltage of $V_{DD}$ may vary considerably depending on the particular application of the leakage detection assembly 200 and may typically be set to a voltage between 1.5 Volt and 100 Volt. A master clock input, f:clk_1, sets a master clock frequency of the DSP 202.

The leakage detection assembly 200 comprises at least one A/D converter 208 that is configured to sample and digitize the instantaneous voice coil voltage across the speaker terminals 211*a*, 211*b*. The A/D converter 208 furthermore comprises a second input that is configured to sample and digitize an analog voice coil current signal delivered at a second input, Icoil, of the converter 208. The skilled person will appreciate that the least one A/D converter 208 may comprise a multiplexed type of converter alternatingly sampling the voice coil voltage and analog voice coil current signal. Alternatively, the least one A/D converter 208 may comprise two separate A/D converters fixedly coupled to the voice coil voltage and the voice coil current signal, respectively. The skilled person will appreciate that the voice current signal may be generated by various types of current sensors that generate a voltage, current or charge signal proportional to the instantaneous voice coil current flowing the voice coil. Exemplary current sensors include a current mirror connected to an output transistor of the H-bridge 206 and a small sense resistor coupled in series with the voice coil of the loudspeaker 1. The at least one A/D converter 208 is clocked by an external sample clock, f_clk2, that may have a frequency between 8 kHz and 96 kHz for non-oversampled types of A/D converters and a frequency between 1 MHz and 10 MHz for oversampled types of A/D converters such as sigma-delta converters.

The at least one A/D converter 208 has a first output supplying a digital voice coil current signal Im[n] to a first input of an adaptive digital model 210 of the loudspeaker 1 wherein the model 210 comprises a plurality of adaptable model parameters as discussed in further detail below. The at least one A/D converter 208 furthermore comprises a second output supplying a digital voice coil voltage Vm[n] to a second input of the adaptive digital model 210. The adaptive digital model 210 of the loudspeaker preferably comprises an adaptive filter which models the frequency dependent impedance of the loudspeaker across a predetermined audio frequency range, for example between 10 Hz and 10 kHz, based on the detected or measured voice coil current and voice coil voltage as represented by the digital voice coil current signal Im[n] and the digital voice coil voltage Vm[n]. The operation of the adaptive digital model 210 is discussed in further detail below. The adaptive digital model 210 is configured to computing or determining a fundamental resonance frequency of the enclosure mounted miniature loudspeaker 1. The output of the adaptive digital model 210 comprises the determined fundamental resonance frequency $f_0$ which is supplied to the DSP 202 in digital format for example via a data bus and a data communication port of the DSP 202.

The DSP 202 is configured to continuously or discontinuously read a current value of $f_0$ and compare it with a nominal fundamental resonance frequency of the miniature loudspeaker 1 representing a sealed state of the enclosure representing. Hence, the nominal fundamental resonance frequency represents the fundamental resonance frequency in the desired sealed state of the enclosure. The nominal fundamental resonance frequency of the miniature loudspeaker 1 is preferably stored in a predetermined data memory address of a data memory accessible to the DSP 202. The nominal fundamental resonance frequency of the miniature loudspeaker 1 may have been obtained in numerous ways. In one embodiment, the nominal fundamental resonance frequency is determined directly from the speaker manufacturer's data sheet for actual volume of the sealed enclosure 31. In this case, the nominal fundamental resonance frequency may represent an average enclosure mounted resonance frequency for the particular type of miniature loudspeaker 1. This embodiment may be used to verify correct sealed mounting of the miniature loudspeaker 1 in the enclosure or chamber 31 during manufacturing. This verification may be accomplished by measuring the fundamental resonance frequency $f_0$ of the miniature loudspeaker 1 after enclosure mounting and compare the measured $f_0$ with the nominal fundamental resonance frequency. If the measured value of the fundamental resonance frequency $f_0$ falls outside certain a predetermined frequency band or range around the nominal fundamental resonance frequency, the enclosure is flagged as leaking. This may be used to repair the enclosure and/or the mounting of the miniature loudspeaker 1 therein during the manufacturing process and hence avoid expensive and annoying field returns of the portable communication device housing the enclosure mounted miniature loudspeaker 1.

In other embodiments, the above outlined average resonance frequency value determination may be less accurate than desired because the moving mass and diaphragm suspension compliance of the miniature loudspeaker 1 tend to vary due to production and material tolerances. Hence, the nominal fundamental resonance frequency of the miniature loudspeaker 1 is determined from an actual measurement on the of the miniature loudspeaker 1 after mounting in the sealed enclosure 31. This may be accomplished during manufacturing of the mobile terminal if the enclosure 31 is known to be appropriately sealed and the miniature speaker 1 in proper working condition.

If the DSP 202 determines that the current $f_0$ of the miniature loudspeaker 1 deviates from the nominal fundamental resonance frequency with more than a preset error criteria such as a certain frequency difference or a certain frequency amount, the DSP 202 preferably proceeds to limiting excursion of the diaphragm of the miniature loudspeaker 1 based on the assumption that the enclosure has become acoustically leaking due to a hole or crack. In this situation, a continued unrestrained or unmodified application of drive voltage to the loudspeaker through the class D output amplifier is likely to cause the previously discussed excessive diaphragm excursion or displacement that may irreversibly damage the loudspeaker. The DSP 202 may be configured or programmed to limit the diaphragm excursion in various ways for example by attenuating a level of the processed digital input signal to the class D output amplifier. This may be accomplished by selectively attenuating low-frequency components of the processed digital input signal (which are more likely to drive the loudspeaker above its maximum allowable excursion limit) or broad band attenuating the entire frequency spectrum of the processed digital input signal.

Generally, the DSP 202 may be configured to respond to an event where the preset error criterion has been exceeded in at least two different ways. According to one set of embodiments, the DSP 202 is configured to respond immediately to non-compliance with the preset error criterion and apply the previously discussed limitation of diaphragm excursion or displacement. These embodiments have the advantage that the time period during which potentially dangerous levels of voice coil voltage is applied to the miniature loudspeaker is minimized. However, in other embodiments, the DSP 202 is configured to on purpose delay the limiting of the diaphragm excursion. According to the latter embodiments, the DSP 202 is configured to detect a failure time during which the determined fundamental resonance frequency exceeds the predetermined error criteria. Only when, and if, the detected failure time exceeds a predetermined failure time period, the DSP 202 proceeds to limit diaphragm excursion. The failure time may for example be detected by a counter in the DSP 202 which is initialized or started instantly in response to exceedance of the predetermined error criteria. A significant advantage of these embodiments is its robustness against short term error conditions or signal glitches. The embodiment may additionally be helpful to let the leakage detection assembly and methodology ignore certain acceptable handling events where a frontal cavity above the miniature loudspeaker has been temporarily blocked by a user. This kind of temporary blocking, which may be caused by placing the sound aperture of the portable communication device against a hard table surface or similar blocking surface, will often lead to an increase of the measured fundamental resonance frequency of the miniature speaker even though the speaker enclosure in fact is perfectly intact, i.e. without acoustic leakage. This blocked acoustic condition or situation of the frontal cavity and the detection thereof are discussed in additional detail below in connection with FIG. 5.

The skilled person will appreciate that the adaptive digital model 210 of the loudspeaker 1 may be implemented by a software programmable microprocessor or DSP core controlled by executable program instructions such that each signal processing function may be implemented by a particular set of executable program instructions. In certain embodiments, the adaptive digital model 210 may be fully or partially integrated with the programmable DSP 202. In the latter embodiments, the adaptive digital model 210 may be implemented by a dedicated set of executable program instructions and a plurality of memory locations holding a plurality of adaptable model parameters of the speaker model 210. Hence, the adaptive modelling of the miniature loudspeaker and the above-discussed monitoring of $f_0$ of the miniature loudspeaker 1 and associated diaphragm excursion limitation procedures may all be carried out by the programmable DSP 202 through suitable application programs. The skilled person will understand that the programmable DSP 202 may be integrated together with the previously discussed application processor of the portable communication terminal or be implemented as a separate programmable DSP dedicated to the present leakage detection assembly and associated leakage detection methodology. In the latter embodiment, the adaptive digital model 210 may be implemented as a separate hard-wired digital logic circuit comprising appropriately configured sequential and combinatorial digital logic instead of a set of executable program instructions associated with the software implementation on the programmable embodiment. The hard-wired digital logic circuit may be integrated on an Application Specific Integrated Circuit (ASIC) or configured by programmable logic or any combination thereof.

Figure 3:
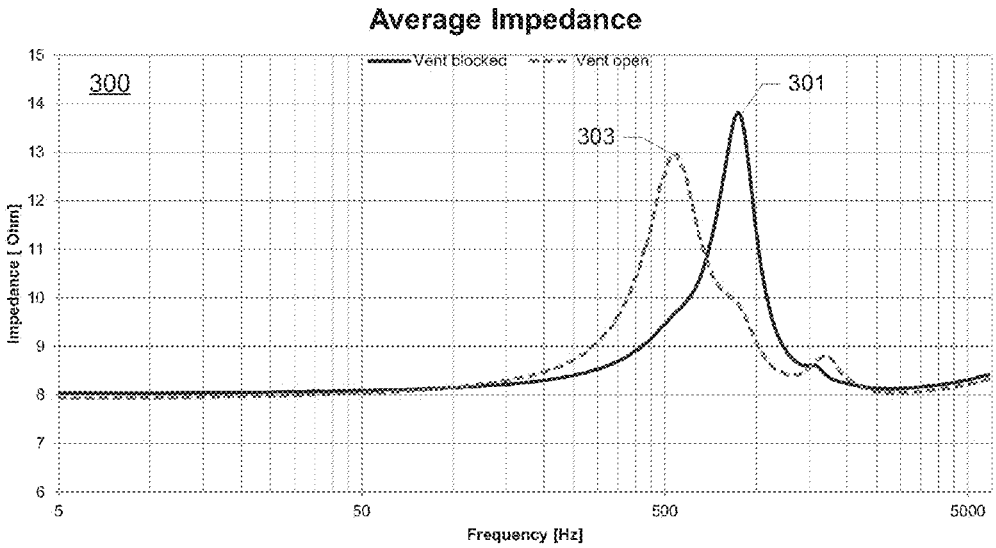
FIG. 3 is a graph of experimentally measured average loudspeaker impedance versus frequency curves for a set of miniature electrodynamic loudspeakers.

To illustrate how the fundamental resonance frequency of the miniature loudspeaker 1 changes when the normally sealed enclosure (30 of FIG. 1B)) is broken and becomes acoustically leaking, the graph 300 of FIG. 3 shows experimentally measured average loudspeaker impedance versus frequency curves for a set of miniature electrodynamic loudspeakers of the same type as the above-discussed miniature loudspeaker 1. The x-axis of graph 300 depicts measurement frequency on a logarithmic scale across a frequency range from 5 Hz to about 5 kHz and the y-axis shows the measured electrical impedance magnitude on a linear scale from approximately 6Ω to 15Ω. A first impedance curve 301 shows the average measured magnitude of the impedance of the miniature loudspeakers when mounted in an unbroken or sealed enclosure, i.e. the intended sealed operation of the loudspeaker and its enclosure. The average fundamental resonance frequency of the measured loudspeakers is approximately 900 Hz and average peak impedance about 14Ω. A second impedance curve 303 shows the average measured impedance when the miniature loudspeakers are mounted in a broken or unsealed enclosure, i.e. the error or failure condition of the loudspeaker and its associated enclosure. As illustrated, the average fundamental resonance frequency of the measured loudspeakers has been lowered markedly to approximately 550 Hz and the average peak impedance lowered to about 13Ω. The average cross-sectional area of the apertures or holes in enclosure was about 0.75 $mm^2$ which the inventors have found representative for typical broken loudspeaker enclosures after numerous field studies.

The pronounced variation of the average fundamental resonance frequency in the sealed and broken conditions of the enclosure makes the present leakage detection methodology very robust against unavoidable production spread of the fundamental loudspeaker resonance frequency. It may for example be possible to choose a threshold frequency criterion for the fundamental resonance frequency such that the leakage detection flags a leakage error if the measured fundamental resonance frequency falls below a predetermined threshold frequency says 750 Hz for the depicted embodiment. The skilled person will appreciate that the threshold frequency criterion in the alternative to absolute frequency could be expressed as a certain frequency deviation from a nominal fundamental resonance frequency for example 250 Hz, or ⅓ octave etc.

Figure 4:
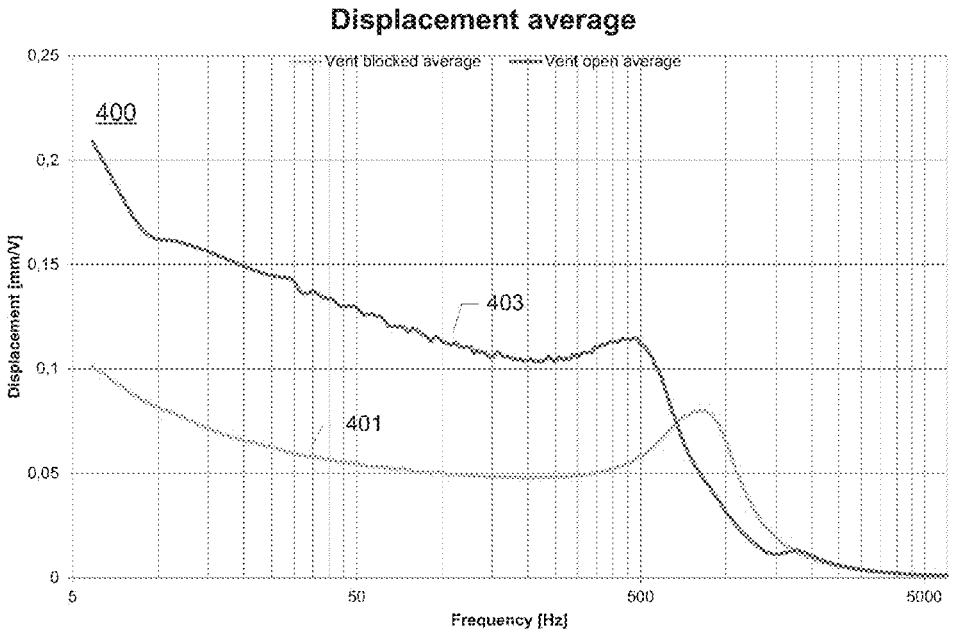
FIG. 4 is graph of experimentally measured average diaphragm excursion versus frequency curves for the set of miniature electrodynamic loudspeakers.

The effect of the broken or leaking loudspeaker enclosure on the loudspeaker excursion or displacement is illustrated on the graph 400 of FIG. 4. The depicted excursion curves 401 and 403 correspond to the average impedance curves 301 and 303, respectively, depicted on graph 300. The x-axis of graph 400 depicts measurement frequency on a logarithmic scale across the frequency range 5 Hz to about 5 kHz while the y-axis shows the measured excursion in mm per Volt (voice coil voltage) on a linear scale from approximately 0.0 mm to 0.25 mm. The depicted diaphragm excursion values were measured by a laser interferometer. A marked increase of average loudspeaker diaphragm excursion is evident from the first excursion curve 401 to the second excursion curve 403 for the fixed voice coil voltage condition applied. The average diaphragm excursion increases markedly throughout the entire low frequency audio range from 20 Hz to 500 Hz when there is acoustic leakage of the enclosures. The average diaphragm excursion at 50 Hz when the miniature loudspeakers are mounted in sealed loudspeaker enclosures is about 0.05 mm/V and this value increases to about 0.13 mm/V when the miniature loudspeakers instead are mounted in the leaky or unsealed loudspeaker enclosures. Since the majority of signal energy of normal speech and music signals is concentrated in the low frequency range, the pronounced increase of diaphragm excursion in this frequency range can lead to irreversible mechanical damage of the speaker unless proper precautionary actions are taken to limiting the maximum excursion. The maximum excursion of a particular type of electrodynamic loudspeaker depends on its dimensions and construction details. For the above-discussed miniature loudspeaker 1 with outer dimensions of approximately 11 mm×15 mm, the maximum diaphragm excursion is about +/−0.45 mm.

Figure 5:
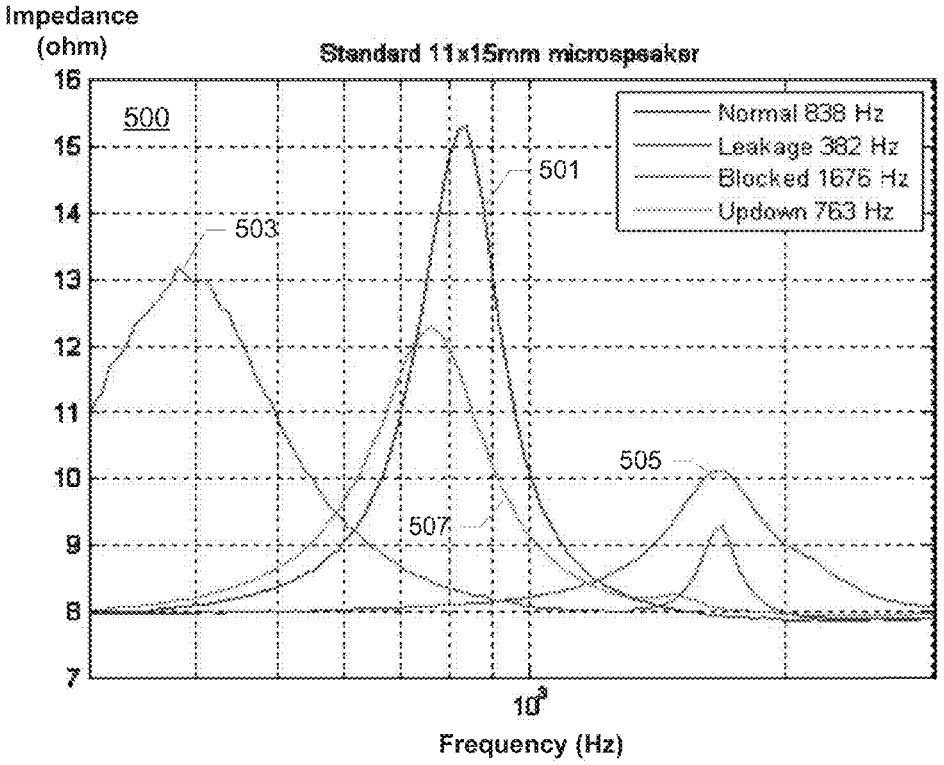
FIG. 5 is graph of four experimentally measured loudspeaker impedance versus frequency curves for a single miniature electrodynamic loudspeaker arranged under four different acoustic loading conditions.

FIG. 5 comprises a graph 500 of experimentally measured loudspeaker impedance versus frequency curves for a single miniature electrodynamic loudspeaker sample arranged in four different acoustic loading conditions, i.e. loaded by different acoustic loads. The miniature electrodynamic loudspeaker sample is similar to the miniature loudspeakers discussed above in connection with the previous impedance and excursion measurements. The x-axis of graph 500 depicts measurement frequency on a logarithmic scale across a frequency range from 300 Hz to about 3 kHz and the y-axis shows the measured electrical impedance magnitude of the miniature speaker on a linear scale spanning from approximately 7Ω to 16Ω. A first impedance curve 501 shows a measured impedance magnitude when the miniature loudspeaker is mounted in an unbroken or sealed enclosure, i.e. the intended or normal sealed condition of the loudspeaker and its enclosure. Furthermore, the frontal cavity above the loudspeaker is unblocked corresponding to sound emission under essentially free field loading conditions.

The measured fundamental resonance frequency of the loudspeaker sample is 838 Hz and the accompanying peak impedance is about 15Ω. A second impedance curve 503 shows the measured impedance magnitude when the miniature loudspeaker is mounted in a leaking or unsealed enclosure, i.e. the error or failure condition of the loudspeaker and its associated enclosure. As illustrated, the measured fundamental resonance frequency of the miniature loudspeaker sample drops markedly from 838 Hz to approximately 382 Hz. A third impedance curve 505 shows the measured impedance magnitude of the miniature loudspeaker when mounted in a sealed or non-leaking enclosure as represented by frequency curve 501, but now with a tightly blocked frontal cavity above the loudspeaker. The tightly blocked acoustic loading condition was achieved by firmly pressing the frontal side of the miniature loudspeaker sample against a paper stack. As illustrated by impedance curve 505, the measured fundamental resonance frequency of the miniature loudspeaker sample increases markedly from 838 Hz under a normal non-leaking operating condition to 1676 Hz with the tightly blocked frontal cavity. The impedance magnitude at the measured fundamental resonance frequency decreases from about 15Ω to about 10Ω. The increase of the fundamental resonance frequency is caused by an increase of the mechanical stiffness of the trapped air mass at the front side of the miniature loudspeaker inside the frontal cavity. Finally, a fourth impedance curve 507 shows the measured impedance magnitude of the miniature loudspeaker when mounted in a sealed or non-leaking chamber as represented by frequency curve 501, but now with a loosely blocked frontal cavity above the loudspeaker. The loosely blocked acoustic loading condition was achieved by resting, rather than actively forcing as in the tightly blocked condition discussed above, the frontal side of the miniature loudspeaker sample against the paper stack. As illustrated by curve 507, the measured fundamental resonance frequency of the miniature loudspeaker sample decreases from 838 Hz under a normal non-leaking operating condition to 763 Hz with loosely blocked frontal cavity. The impedance magnitude at the measured fundamental resonance frequency decreases from about 15Ω to about 12Ω.

The variation of the fundamental resonance frequency between the sealed condition of the enclosure and the tightly blocked and loosely blocked frontal cavity makes the present leakage detection methodology able to additionally detect whether a change of the measured fundamental loudspeaker resonance frequency of the miniature loudspeaker is caused by an acoustical blocking of the frontal cavity of the loudspeaker. The skilled person will appreciate that detection or discrimination efficiency of enclosure leakage may be improved by monitoring and measuring the impedance or admittance of the loudspeaker at the fundamental resonance frequency in addition to detecting the change of fundamental resonance frequency of the miniature loudspeaker. The measured impedance or admittance of the loudspeaker at the fundamental resonance frequency may for example be compared to a predetermined impedance error criterion such as upper and/or lower impedance threshold values(s).

According to one embodiment of the invention, the detection of the above-discussed tightly blocked or loosely blocked frontal cavity operating conditions of the miniature loudspeaker is used to temporarily interrupt the audio or drive signal to the loudspeaker and thereby halt sound reproduction. This saves power. Sound reproduction is preferably resumed once normal acoustic operating conditions of the miniature loudspeaker are re-established, i.e. once the measured fundamental resonance frequency of the loudspeaker no longer complies with the predetermined frequency error criterion and/or impedance error criterion. Furthermore, the enclosure leakage detection methodology is preferably also adapted to permanently, or least until the enclosure has been repaired, attenuate the level of the audio signal applied to the voice coil of the miniature loudspeaker if the enclosure is determined to be leaking as discussed above.

Figure 6:
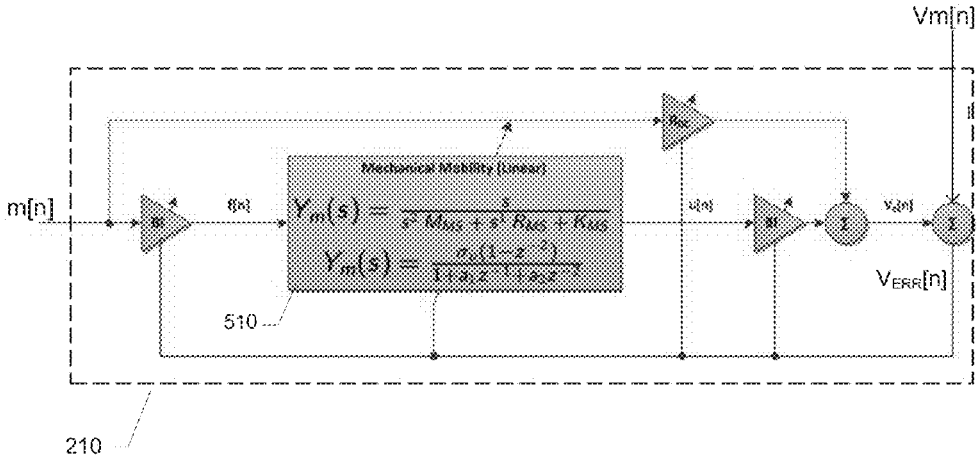
FIG. 6 shows an adaptive IIR filter based model of the miniature electrodynamic loudspeaker for fundamental loudspeaker resonance monitoring and detection.

FIG. 6 is a detailed view of interior components of the previously discussed adaptive digital model 210 of the loudspeaker 1. The adaptive digital model 210 comprises an adaptive IIR filter 510 which adaptively tracks or models the impedance of the voice coil of the miniature electrodynamic loudspeaker 1 for fundamental resonance frequency tracking and detection. The previously discussed digital voice coil current signal Im[n] is applied to a first input of the adaptive digital model 210 and the digital voice coil voltage Vm[n] is applied to a second input of the adaptive digital model 210. The output (not shown) of the digital model 210 is the estimated fundamental resonance frequency $f_0$ of the miniature loudspeaker 1. This output is not expressly depicted on FIG. 5, but can be computed directly from the model parameters of the adaptive IIR filter 510 as discussed below in further detail.

The adaptive digital model 210 comprises the following model parameters:

$V_e$ [n]: Estimate of voice coil voltage or drive voltage;

$R_{DC}$: DC electrical resistance of voice coil;

BI: Force factor of loudspeaker (B·I product);

$M_{MS}$: Total mechanical moving mass (including acoustic loading);

$K_{MS}$: Total mechanical stiffness;

$R_{MS}$: Total mechanical damping;

The adaptive IIR filter 510 is a second order filter and for convenience preferably expressed by its mechanical mobility transfer function $Y_m(s)$ in the z-domain as illustrated by the lower mobility equation. The overall operation of the adaptive digital model 210 of the loudspeaker 1 is that a parameter tracking algorithm tries to predict the voice coil voltage $V_e[n]$ based upon a measurement of the voice coil current Im[n] and an impedance model of the miniature loudspeaker. An error signal $V_{ERR}[n]$ is obtained from a difference between the measured, actual, voice coil voltage Vm[n] and the estimate of the same produced by the model $V_e[n]$. The skilled person will understand that various adaptive filtering methods may be used to adapt free model parameters in the chosen loudspeaker model to minimise the error signal $V_{ERR}[n]$. The free model parameters are preferably continuously transmitted to the DSP 202 and when the error signal becomes sufficiently small, e.g. comply with a predetermined error criterion, the adapted model parameters are assumed to be correct. The DSP 202 is configured to make the computation of the current fundamental resonance frequency $f_0$ of the miniature loudspeaker 1 from the received model parameters. In the alternative, the adaptive digital model 210 may include appropriate computing power to perform the computation of $f_0$ and transmit the latter to the DSP 202. By keeping fixed one of the four parameters BI, $M_{MS}$, $K_{MS}$ and $R_{MS}$ depicted in FIG. 5 the residual three parameters can be determined by identifying the relationship between Im[n] and u[n]. Mathematically, it is unimportant which one of these four parameters that is fixed but the total moving mass $M_{MS}$ is the typically the most stable of these parameters in terms of manufacturing spread and variation over time and temperature. Therefore, it is preferred to keep the total moving mass $M_{MS}$ as a fixed parameter in the present embodiment of the invention.

The skilled person will appreciate that $f_0$ can be calculated analytically from the free parameters $a_1$ and $a_2$ leading initially to $$\omega_z = \sqrt{\ln^2(\sqrt{a_2}) + \arctan^2\left(-\frac{\sqrt{-a_1^2 + 4a_2}}{a_1}\right)} = \omega_0 / F_s$$

Hence, $\omega_0$ can be found by multiplying $\omega_z$ with the sampling frequency, $F_s$, of the digital model signals and $f_0$ finally computed by:

$$f_0 = \omega_0 / 2\pi.$$

The invention claimed is:

1. A method of detecting enclosure leakage of an electrodynamic loudspeaker mounted in an enclosure, comprising steps of:

applying an audio signal to a voice coil of the electrodynamic loudspeaker through an output amplifier, detecting a voice coil current flowing into the voice coil, detecting a voice coil voltage across the voice coil, applying the detected voice coil current and the detected voice coil voltage to an adaptive digital model of the loudspeaker to determine one of an impedance and an admittance of the loudspeaker across a predetermined audio frequency range, to determine a plurality of adaptable parameters of the adaptive digital model of the loudspeaker, determining a fundamental resonance frequency of the loudspeaker from one or more of the adaptable parameters of the adaptive digital model of the loudspeaker, comparing the determined fundamental resonance frequency of the loudspeaker with a nominal fundamental resonance frequency of the loudspeaker representing a sealed state of the enclosure, detecting an acoustic leakage of the enclosure based on a deviation between the determined fundamental resonance frequency and the nominal fundamental resonance frequency of the electrodynamic loudspeaker.

2. The method of claim 1, comprising steps of:

filtering the voice coil current by a plurality of adjacently arranged bandpass filters across the predetermined audio frequency range to produce a plurality of bandpass filtered voice coil current components, filtering the voice coil voltage by a plurality of adjacently arranged bandpass filters across the predetermined audio frequency range to produce a plurality of bandpass filtered voice coil voltage components, and determining one of the impedance and the admittance of the loudspeaker within a pass band of each bandpass filter based on the voice coil current component and voice coil voltage component.

3. The method of claim 2, wherein the plurality of adjacently arranged bandpass filters comprises one of a time-domain filter bank and a frequency domain filter bank.

4. The method of claim 3, the frequency domain filter bank comprises a Fourier Transform based filter bank.

5. The method of claim 3, wherein the time domain filter bank comprises a plurality of ⅓ octave bandpass filters.

6. The method of claim 1, wherein the adaptive digital model of the loudspeaker comprises an adaptive IIR filter of second or higher order.

7. The method of claim 1, wherein the adaptive digital model of the loudspeaker comprises at least one fixed parameter such as a total moving mass of the loudspeaker.

8. The method of claim 1, comprising steps of:

monitoring and determining the fundamental resonance frequency of the loudspeaker over time, comparing the determined fundamental resonance frequency with a predetermined frequency error criterion, and limiting diaphragm excursion of the loudspeaker based on an outcome of the comparison.

9. The method of claim 8, wherein the predetermined frequency error criterion comprises a maximum frequency deviation between the determined fundamental resonance frequency and the nominal fundamental resonance frequency of the loudspeaker.

10. The method of claim 8, wherein the predetermined frequency error criterion comprises a threshold frequency derived from the nominal fundamental resonance frequency of the loudspeaker.

11. The method of claim 8, comprising steps of:

detecting a failure time during which the determined fundamental resonance frequency meets the predetermined frequency error criterion, comparing the detected failure time with a predetermined failure time period, and limiting the diaphragm excursion in response to the detected failure time exceeds the predetermined failure time period.

12. The method of claim 8, comprising steps of:

monitoring and determining one of the impedance or the admittance of the loudspeaker at the fundamental resonance frequency.

13. The method of claim 12, comprising steps of:

comparing the determined impedance or admittance of the loudspeaker at the fundamental resonance frequency to a predetermined impedance error criterion, and limiting diaphragm excursion of the loudspeaker based on an outcome of the comparison.

14. The method of claim 8, wherein the limiting of diaphragm excursion comprises a step of attenuating one of a level of the audio signal and a level of the voice coil current.

15. The method of claim 14, wherein the attenuation of the level of the audio signal comprises selectively attenuating a low-frequency portion of the audio signal below the nominal fundamental resonance frequency of the electrodynamic loudspeaker.

16. A leakage detection assembly for an enclosure mounted electrodynamic loudspeaker, comprising:

an audio signal input for receipt of an audio input signal supplied by an audio signal source, an output amplifier configured to receive the audio input signal and generate a corresponding voice coil voltage at a pair of output terminals connectable to a voice coil of an electrodynamic loudspeaker, a current detector configured for detecting a voice coil current flowing into the electrodynamic loudspeaker in response to the application of the voice coil voltage; and a signal processor configured to:

apply the detected voice coil current and the voice coil voltage to an adaptive digital model of the loudspeaker to determine one of an impedance and an admittance of the loudspeaker across a predetermined audio frequency range, to determine a plurality of adaptable parameters of the adaptive digital model of the loudspeaker, determine a fundamental resonance frequency of the loudspeaker from one or more of the adaptable parameters of the adaptive digital model of the loudspeaker, compare the determined fundamental resonance frequency of the loudspeaker with a nominal fundamental resonance frequency of the loudspeaker representing a sealed state of the enclosure, and detect an enclosure leakage based on a deviation between the determined fundamental resonance frequency and the nominal fundamental resonance frequency of the electrodynamic loudspeaker.

17. The leakage detection assembly of claim 16, wherein the current detector comprises a first A/D converter configured to sample and digitize the voice coil current to supply a digital voice coil current signal; and a second A/D converter configured to sample and digitize the voice coil voltage to supply a digital voice coil voltage signal.

18. The leakage detection assembly of claim 16, wherein the signal processor comprises a programmable microprocessor controllable by an application program of executable program instructions stored in a program memory.

19. The leakage detection assembly of claim 18, wherein the application program comprises:

a first set of executable program instructions providing, when executed, the adaptive digital model of the loudspeaker;

a second set of executable program instructions providing, when executed, steps of:

reading the digital voice coil current signal, reading a digital voice coil voltage signal, applying the digital voice coil current signal and the digital voice coil voltage signal to the adaptive digital model of the loudspeaker, computing updated values of the plurality of adaptable model parameters, and determining the fundamental resonance frequency of the loudspeaker from one or more of the adaptable model parameters.

20. The leakage detection assembly of claim 18, wherein the application program comprises:

a first set of executable instructions configured to, when executed, providing steps of:

filtering the digital voice coil voltage signal by a plurality of adjacently arranged bandpass filters across the predetermined audio frequency range to produce a plurality of bandpass filtered voice coil voltage components, filtering the digital voice coil current signal by a plurality of adjacently arranged bandpass filters across the predetermined audio frequency range to produce a plurality of bandpass filtered voice coil current components, and determining one of the impedance and the admittance of the loudspeaker within a pass band of each bandpass filter based on the voice coil current component and voice coil voltage component.

21. The leakage detection assembly of claim 16, wherein the output amplifier comprises a class D power stage configured to supply a pulse modulated voice coil voltage to the electrodynamic loudspeaker.

22. A semiconductor substrate having a leakage detection assembly according to claim 15 integrated thereon.

23. A leakage detection system for an enclosure mounted electrodynamic loudspeaker, comprising:

an electrodynamic loudspeaker comprising a movable diaphragm assembly for generating audible sound in response to actuation of the diaphragm assembly, a leakage detection assembly according to claim 16 electrically coupled to the movable diaphragm assembly, and an audio signal source operatively coupled to the audio signal input of the leakage detection assembly.

* * * * *